US006704940B1

(12) United States Patent
Convery et al.

(10) Patent No.: US 6,704,940 B1
(45) Date of Patent: Mar. 16, 2004

(54) CONVERTIBLE HAT

(76) Inventors: Richard Convery, 41 Bertana Drive, Mudgeeraba, Old (AU), 4213; Peter Alfred James Harriman, 8 Twilight Drive, Mudgeeraba, Old (AU), 4213

( * ) Notice: Subject to any disclaimer, the term of this patent is extended or adjusted under 35 U.S.C. 154(b) by 108 days.

(21) Appl. No.: 10/031,011

(22) PCT Filed: Jul. 10, 2000

(86) PCT No.: PCT/AU00/00832

§ 371 (c)(1),
(2), (4) Date: Jan. 9, 2002

(87) PCT Pub. No.: WO01/03533

PCT Pub. Date: Jan. 18, 2001

(30) Foreign Application Priority Data

Jul. 9, 1999 (AU) ..... PQ 1549
Nov. 15, 1999 (AU) ..... PQ 4052

(51) Int. Cl.[7] ..... A42B 1/00
(52) U.S. Cl. ..... 2/175.1; 2/195.7
(58) Field of Search ..... 223/7; 493/938, 493/937, 939; 2/195.7, 175.1

(56) References Cited

U.S. PATENT DOCUMENTS 1,532,310 A * 4/1925 Funke
1,636,889 A * 7/1927 Wittcoff
2,495,041 A * 1/1950 Weiss ..... 2/177
2,743,455 A * 5/1956 Langness ..... 2/177
5,159,720 A * 11/1992 Scott, Jr. ..... 2/171
5,495,622 A 3/1996 Kaufman
5,664,261 A 9/1997 Lacy

FOREIGN PATENT DOCUMENTS

AU 674645 1/1997
AU 689428 3/1998

* cited by examiner

*Primary Examiner*—John J. Calvert
*Assistant Examiner*—James G Smith
(74) *Attorney, Agent, or Firm*—Reinhart Boerner Van Deuren s.c.

(57) ABSTRACT

A convertible hat including a crown and a brim that can be converted between a conventional hat to a skullcap type configuration, such as a swimming cap. The brim is hingedly connected to the lower peripheral edge of the crown and protruding outwardly from the crown in an operative shading condition. The brim is retractable from the operative condition such that the brim substantially conforms to at least a portion of the outer surface of the crown.

14 Claims, 6 Drawing Sheets

CONVERTIBLE HAT

BACKGROUND OF THE INVENTION

Field of the Invention

The present invention relates generally to a convertible hat, and more particularly, but not exclusively, to a brimmed hat that converts into a skullcap type configuration, such as a swimming cap, and, for illustrative purposes, reference will be made to such application. However, it is to be understood that this invention could be used in other applications, such as a hat which can be folded to a convenient size for storage and portability.

People are becoming better educated about the dangers of the sun and its association with skin cancer. One method of protection from the sun is to wear a hat. However, wearing a hat conventionally has been difficult for persons who swim or participate in other sports.

It is accordingly the primary objective of the present invention that it provide a hat that may be converted between a conventional hat to a skullcap type configuration, such as a swimming cap. The cap of the present invention should achieve the aforesaid objective and the advantages thereof and be achieved without incurring any substantial relative disadvantage.

SUMMARY OF THE INVENTION

The disadvantages and limitations of the background art are overcome by the present invention. With this invention, a hat is disclosed which may be converted between a conventional hat to a skullcap type configuration, such as a swimming cap.

Accordingly, this invention in one aspect resides in a convertible hat including a crown and a brim, wherein the brim is hingedly connected to the lower peripheral edge of the crown, and wherein the brim protrudes outwardly from the crown in an operative condition, and wherein the brim is retractable from the operative condition such that the brim substantially conforms to at least a portion of the outer surface of the crown.

The crown may be any suitable shape for covering the head of a wearer. For example, the crown may be generally dome-shaped and be close fitting to the head of a wearer. The crown may have a generally circular lower peripheral edge for defining the opening to receive the head of a wearer.

The brim may extend radially around substantially the entire lower peripheral edge of the crown and may shade the wearer when worn with the brim protruding outwardly in an operative condition. The brim is hingedly connected to the crown to enable the brim to retract. The hinged connection may provide a pivot point or may simply enable the brim to be retracted such that it substantially conforms to a least a portion of the outer surface of the crown.

The brim may be retractable from the operative condition by any suitable retracting mechanism that upwardly draws or lifts the brim. For example, an elasticized band may be associated with at least the outer edge of the brim and the brim may be held in the operative condition against the influence of the elastic band. The elastic may tension the brim when the brim is in an operative condition. The wearer may be able to bias the tensioned brim to a inoperative or raised position by flexing the brim upwards, wherein the brim retracts on the hinged connection to a position substantially conforming to the crown.

Alternatively, the brim may incorporate outwardly extending stiffeners spaced around the brim and extending between the lower peripheral edge of the crown and the outer edge of the brim. The hinged connection between the lower peripheral edge of the crown and the stiffeners may be an over-center type hinge, which maintains the brim outstretched in a shaded attitude when the outer edge of the brim is below the center edge of the hinge. The elastic band may retract the outer edge of the brim when the brim is raised up over the center position of the hinge.

In another embodiment, one or more drawstrings may be associated with the outer peripheral edge of the brim. The brim may be a soft brim, wherein substantially the entire outer peripheral portion of the brim may be gathered by the drawstring. Alternatively, the brim may be stiffened with spaced apart ribs to permit a portion of the brim between the ribs to be gathered. The portion of the brim which is gathered enables the brim to be retracted to a position overlying and conforming to at least a portion of the outer surface of the crown. The hat may be converted to a skullcap type configuration by gathering the outer edge of the brim to a smaller dimension than the lower peripheral edge of the crown.

The outer edge of the stiffeners may include a locator for locating the drawstring(s) around the outer edge of the brim. For example, the locator may be a fork-like or channel-like member having two opposing sides, wherein the drawstring (s) is located therebetween. Alternatively, the locator may be an eye or conduit wherein the drawstring(s) is threaded therethrough.

The stiffeners and lower peripheral edge of the crown may form a skeleton for a hat in accordance with the invention. The skeleton may be constructed from any suitable material that may be flexible, but substantially firm. For example, the skeleton may be made from plastics materials, such as PVC or other polymers. The skeleton may be covered in a lightweight material or fabric forming the brim and crown. Suitably, the material or fabric is flexible, UV reflective and not adversely affected by immersion in fresh, chlorinated or salt water. The material may also be quick drying.

A wearer may pull the drawstring(s) to gather at least a portion of the outer peripheral edge of the brim. As the brim gathers the stiffeners may retract on the hinged connection and the portion of the brim between the stiffeners gathers and/or folds until the gathered brim conforms to at least a portion of the outer surface of the crown forming a skullcap type configuration. Hats in accordance with the invention may provide protection against the elements, even while swimming.

In another aspect this invention resides in a convertible hat including a crown and a brim connected to a lower peripheral edge of the crown, and gathering means for gathering the outer edge of the brim above the lower peripheral edge of the crown.

In another aspect this invention resides in a brimmed hat including a crown and a brim connected to a lower peripheral edge of the crown, and a pair of drawstrings which may be retracted from a respective side or from respective sides of the brim to provide a chinstrap. The hat may be a hat as defined above.

In a further aspect this invention resides about a retractor for retracting the outer edge of the brim above the lower peripheral edge of the crown.

In a still further aspect this invention resides in a convertible hat including a crown and a brim connected to a lower peripheral edge of the crown, said brim having a plurality of stiffeners outwardly extending between the lower peripheral edge of the crown and the outer edge of the brim, wherein said stiffeners are hingedly connected to said lower peripheral edge, and at least one drawstring associated with the outer edge of the brim.

DESCRIPTION OF THE DRAWINGS

These and other advantages of the present invention are best understood with reference to the drawings, in which.

DETAILED DESCRIPTION OF THE PREFERRED EMBODIMENT

Figure 1:
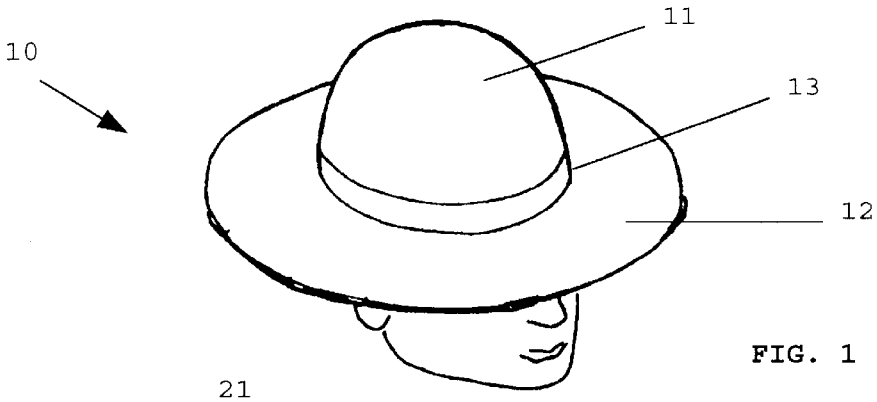
FIG. 1 is a perspective view of a person wearing a hat in an operative condition in accordance with the invention.

FIG. 1 illustrates a hat 10 shading a wearer in an operative condition. The hat includes a crown 11 and a brim 12 connected to and protruding outwardly from the lower peripheral edge of the crown 13. The crown 11 has a generally circular lower peripheral edge 13 for receiving the head of a wearer. The upper portion of the crown 11 is generally dome shaped and fits closely the wearer's head. The brim 12 extends radially around the entire lower periphery of the crown 13.

Figure 2:
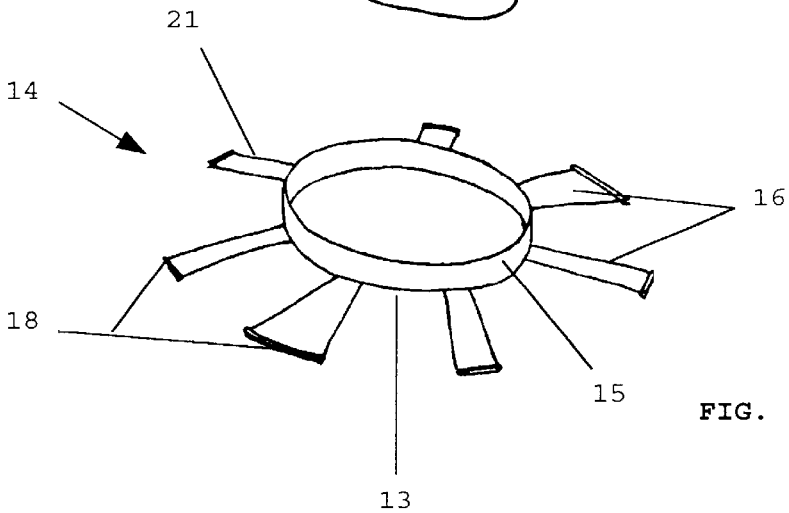
FIG. 2 illustrates the skeleton of the hat.

The hat 10 is constructed from a skeleton 14, as illustrated in FIG. 2. The skeleton 14 includes a head band 15, the lower edge of the head band forming the lower peripheral edge of the crown 13, and a plurality of stiffeners or ribs 16 which extend outwardly between the lower peripheral edge of the crown 13 to the outer edge of the brim 12. The ribs 16 are hingedly connected 17 to the lower edge peripheral of the crown 13. This enables the ribs 16 to move from an outstretched condition when the brim 11 is in a operative condition, to an inoperative condition or raised position, wherein the ribs 16 are verlying an upper portion of the crown 11, substantially conforming to the outer surface of the crown 11.

Figure 3:
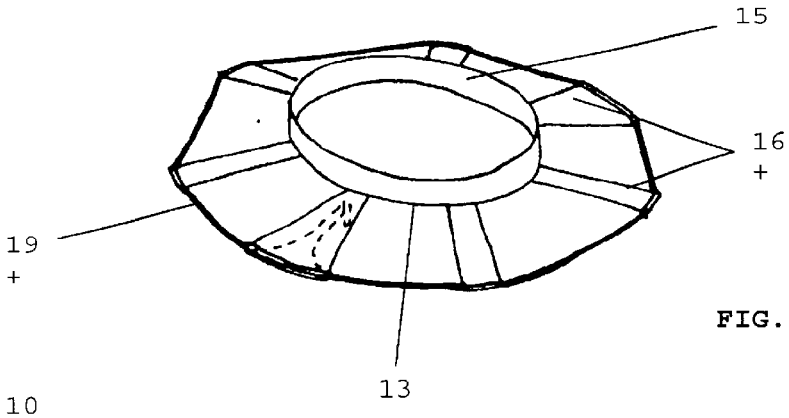
FIG. 3 illustrates the drawstring mechanism of the hat.
Figure 4:
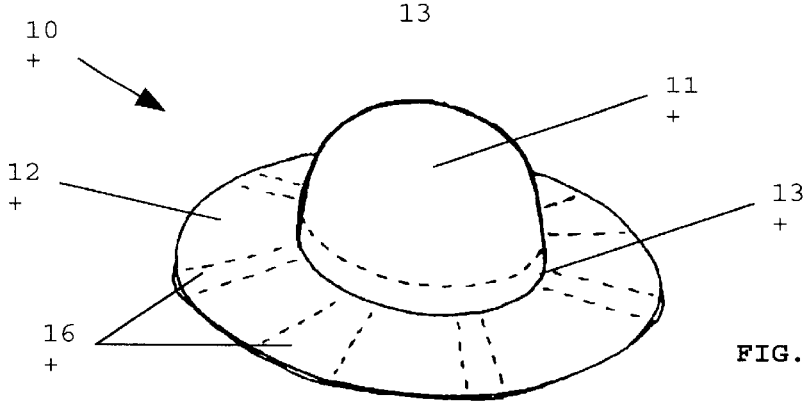
FIG. 4 illustrates the hat with the skeleton shown in hidden detail.
Figure 7:
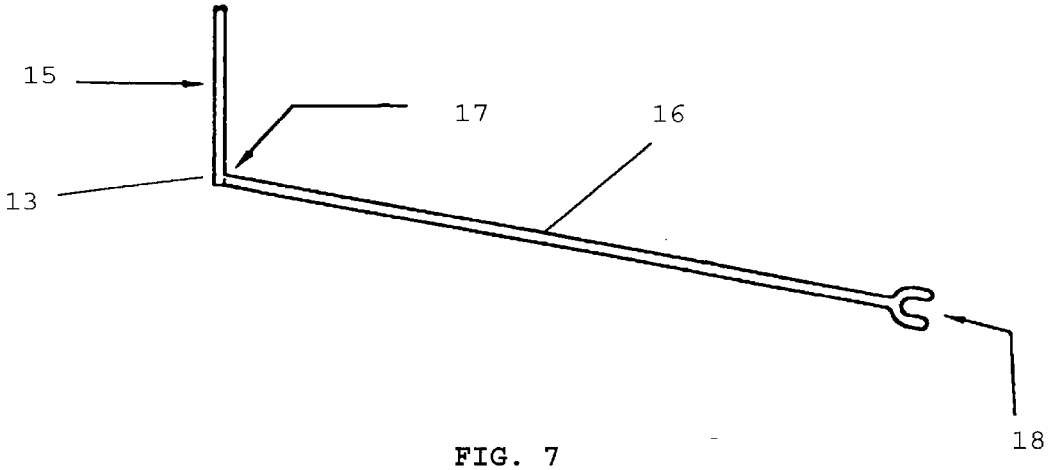
FIG. 7 is a cross-sectional view of a rib connected to the head band.

The outer peripheral edge of the ribs 16 includes a locator 18 for locating one or more drawstrings 19 around the outer edge of the brim 12, as shown in FIG. 3. The locator 18, as best shown in FIG. 7, is a fork-like like or channel-like member having opposing sides. In alternative embodiments, the locator 18 may be an eye or conduit through which the drawstring(s) 19 is threaded.

Figure 5:
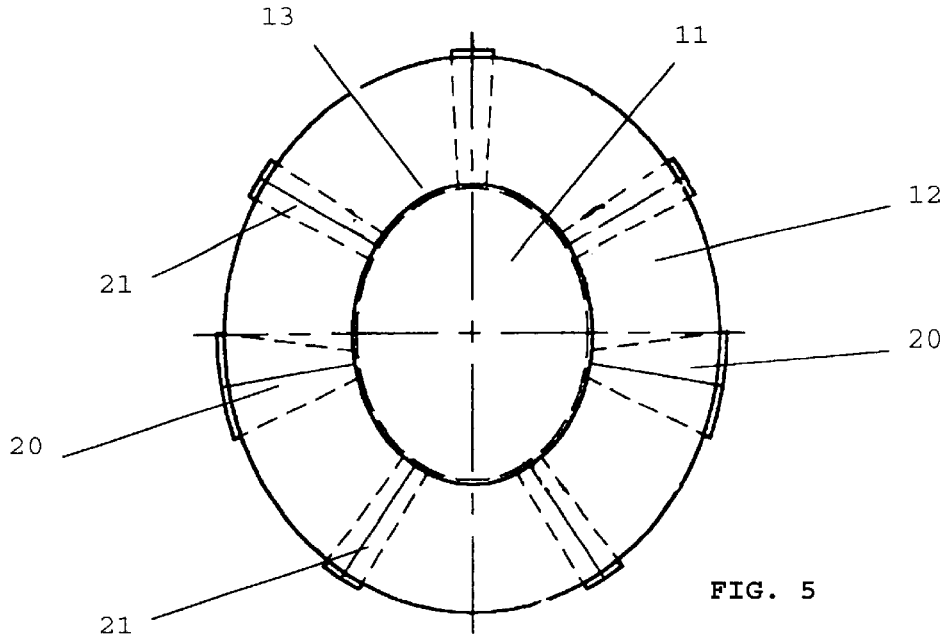
FIG. 5 is a top view of the hat with skeleton shown in hidden detail.
Figure 6:
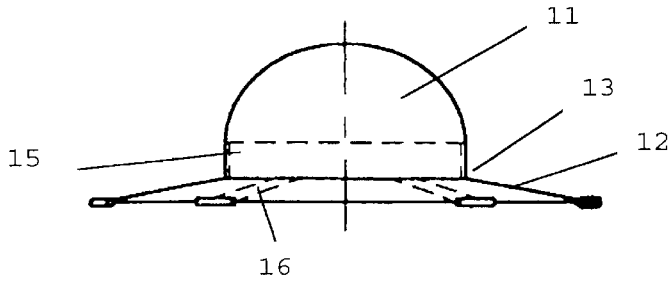
FIG. 6 is a front view of the hat with skeleton shown in hidden detail.
Figure 8:
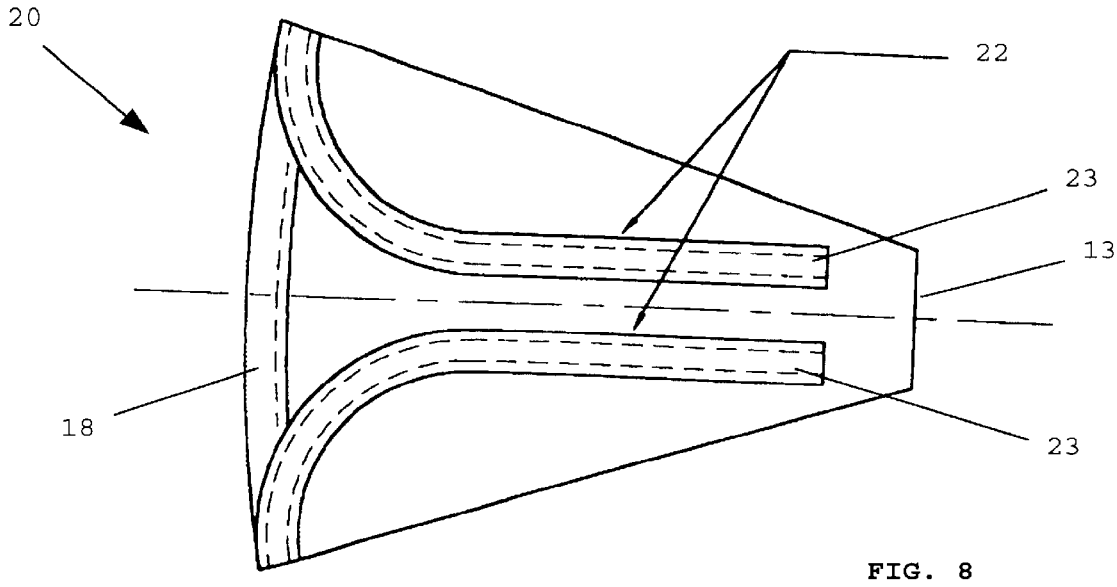
FIG. 8 is an underside view of a wide rib.

The ribs 16 may be different sizes to enable the retracted brim 12 to substantially overlie and conform to the outer surface the crown 11. As illustrated in FIGS. 2 and 5, the skeleton 14 includes two wide ribs 20 and two or more narrow ribs 21 relatively evenly spaced between the wide ribs 20. As shown in FIG. 8, the underside of least one of the wide ribs 20 includes two conduits 22, being an extension of the locator 18. The drawstring 19 is threaded from the locator 18 to the inner portion of the brim 12 adjacent the lower peripheral edge of the crown 13.

Figure 9:
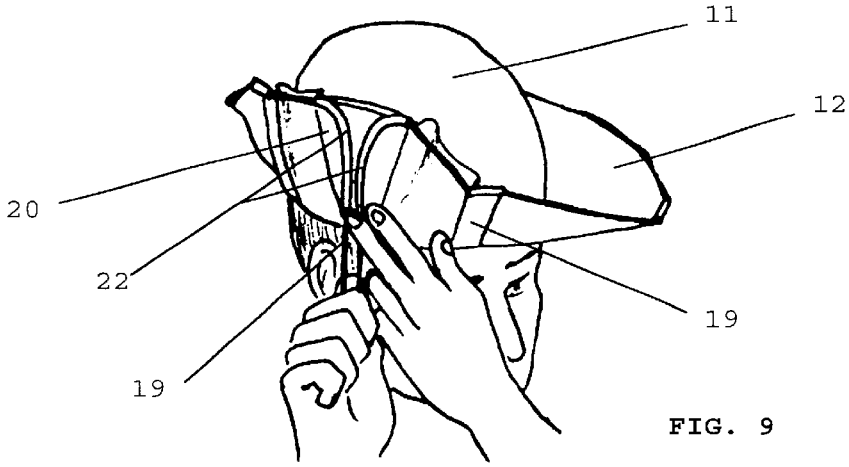
FIG. 9 illustrates a user converting the hat into a skull or swimming cap.
Figure 10:
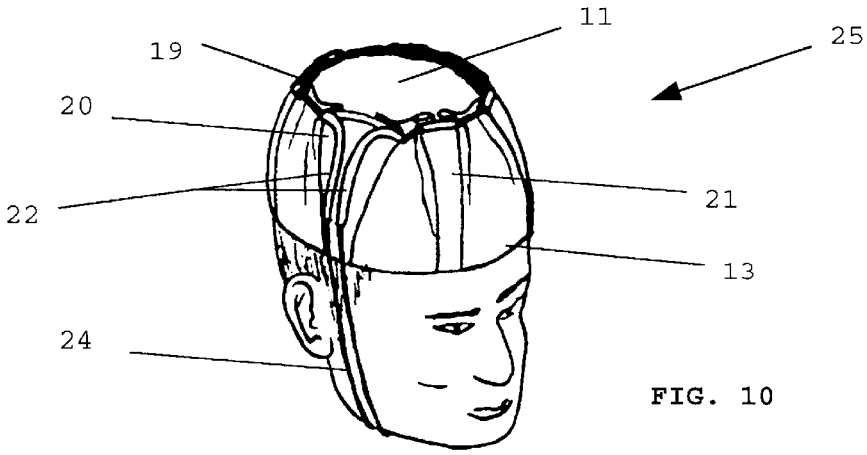
FIG. 10 illustrates a user wearing the hat as a skull or swimming cap.

The wide ribs 20 are each positioned on the brim 12 substantially adjacent the respective ear of a wearer to enable access to the drawstring 19 at the conduit end 23 near his/her ears, as shown in FIG. 9. When the hat 10 is converted to a skullcap type configuration 25, the drawstring 19 may be used as a chinstrap 24 assisting in keeping the cap 25 in position, as shown in FIG. 10. The wide rib is illustrated 20 in FIGS. 9 and 10 to show the mechanism of the drawstring 19. It is to be appreciated that the ribs generally are not observed when the hat 10 is worn in skullcap type configuration 25.

The skeleton 14 is preferably constructed from flexible, but substantially firm plastics material, such as PVC or other polymers, to give suitable support to the brim 12. The skeleton 14 is covered in a lightweight material or fabric to form the crown 11 and brim 12. Suitably, the material is flexible, UV reflective and not adversely affected by immersion in fresh, chlorinated or salt water. The material may also be quick drying.

In another embodiment (not illustrated), the hinged connection 17 between the lower peripheral edge of the crown 13 and the ribs 16 may be an over-center type hinge which maintains the brim 12 outstretched in a operative condition when the outer edge of the brim is below the center edge of the hinge. An elastic band is associated with the outer edge of the brim 12, which retracts the outer edge of the brim 12 when the brim 12 is raised up over the center position of the hinge.

In use, the wearer pulls on the drawstring 19 at the conduit end 23 of at least one of the wide ribs 20 located near each ear. However, for convenience and for ease of gathering of the brim, the user may pull the drawstring 19 at both wide ribs 20. As the drawstring 19 is drawn, the portion of the outer edge of the brim 12 between the ribs 16 gathers and/or folds causing the ribs 16 to retract upward on the hinged connection 17 until the folded brim 12 overlies the crown 13 forming a skullcap type configuration 25, as illustrated in FIGS. 9 and 10. The hat may be secured into place by the chinstrap 24 which is part of the drawstring mechanism.

FIGS. 11 to 19 depict an alternative form of the hat 26 in accordance with the invention. The alternative form of the hat 26 has the appearance of the hat 10 illustrated in FIG. 1 when worn in a shading operative condition. The hat 26 includes a crown 27 and a brim 28 connected the lower peripheral edge of the crown 29.

Figure 11:
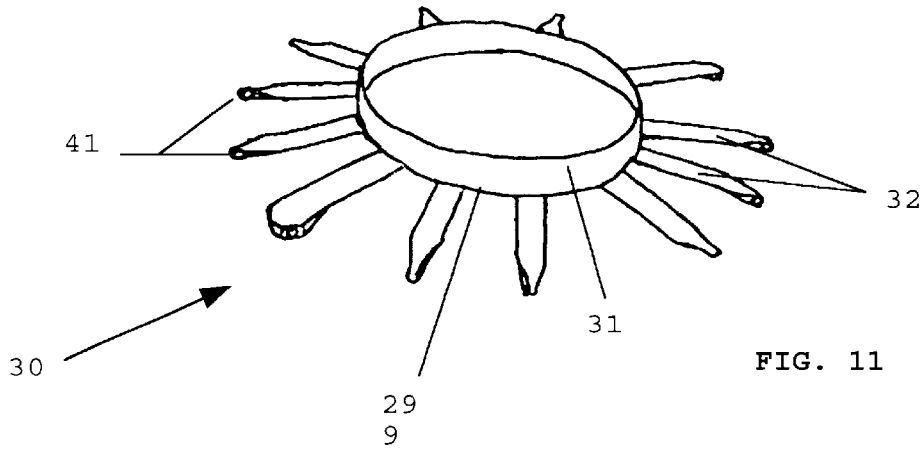
FIG. 11 illustrates the skeleton of an alternative form of the hat in accordance with the invention.
Figure 12:
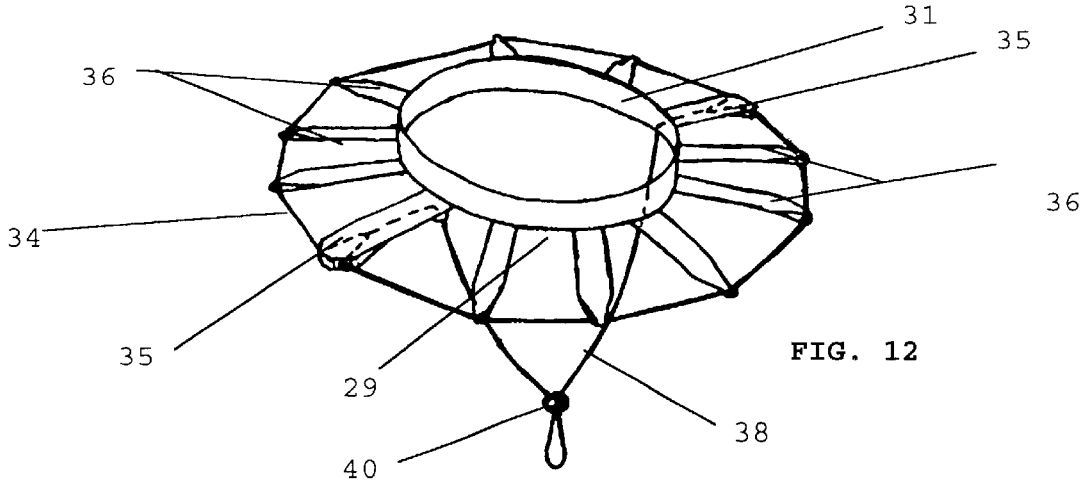
FIG. 12 illustrates the drawstring mechanism of the alternative form of the hat.
Figure 13:
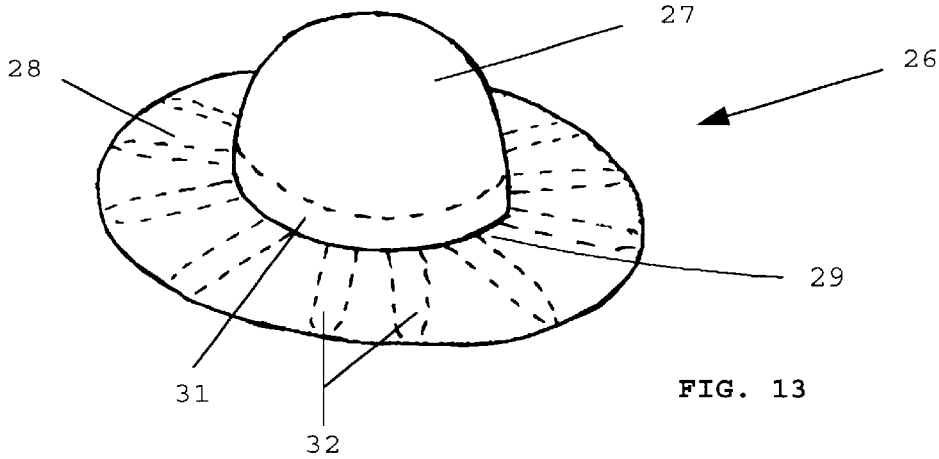
FIG. 13 illustrates the alternative form of the hat with the skeleton shown in hidden detail.
Figure 14:
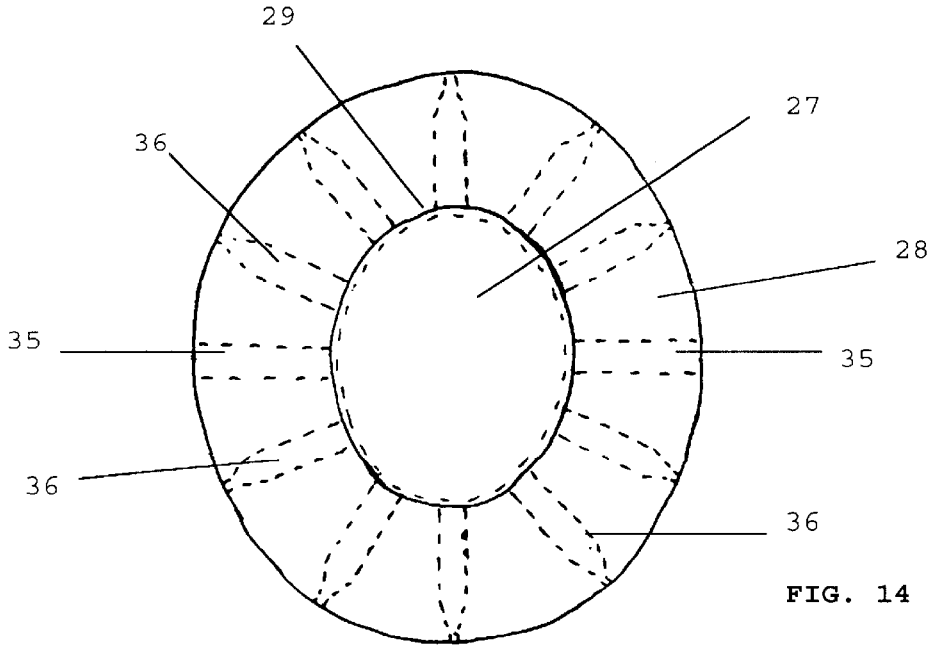
FIG. 14 is a top view of the alternative form of the hat with the skeleton shown in hidden detail.
Figure 15:
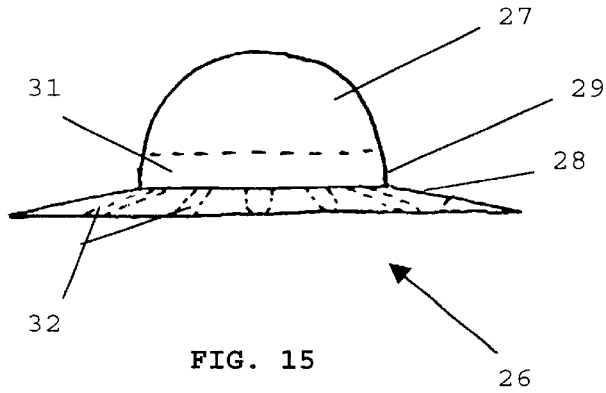
FIG. 15 is a front view of the alternative form of the hat with the skeleton shown in hidden detail.

Referring to FIG. 11, the hat 26 is constructed from a skeleton 30. The skeleton 30 includes a head band 31, the lower edge of the head band 31 forming the lower peripheral edge of the crown 29, and a plurality of ribs 32 which extend outwardly between the lower peripheral edge of the crown 29 to the outer edge of the brim 28. The ribs 32 are hingedly connected 33 to the lower edge of the crown 29 to enable the ribs 32 to move from an outstretched position when the brim 28 is in a operative condition, to an inoperative condition or raised position where the ribs 32 are overlying an upper portion of the crown 27, substantially conforming to the outer surface of the crown 27.

Figure 16:
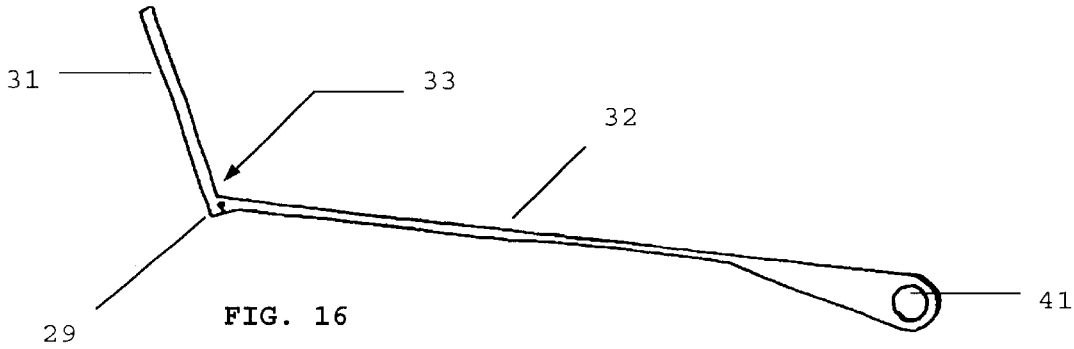
FIG. 16 is a cross-sectional view of a rib connected to the headband of the alternative form of the hat.

As illustrated in FIG. 16, the outer edge of the ribs 32 includes at least one eye or conduit 41 for passing or threading a drawstring 34 therethrough for locating the drawstring around the outer edge of the crown 27. The skeleton 30 includes two guiding ribs 35 positioned on opposite sides of the brim 28 and a plurality of locating ribs 36 relatively evenly spaced between the guiding ribs 35. It is to be understood that the terms guiding and locating are used simply as means to distinguish the two types of ribs and that the terms are not meant to limit the functionality or design of the ribs.

Figure 17:
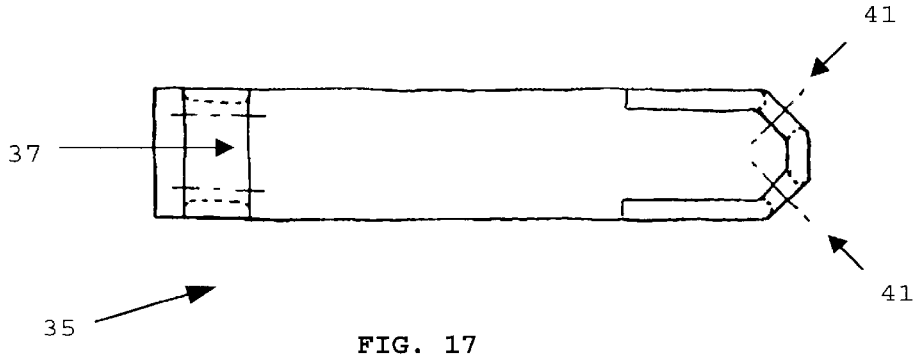
FIG. 17 is an underside view of a guiding rib from the alternative form of the hat.

The guiding rib 35, as illustrated in FIG. 17, guides the drawstring 34 from the lower peripheral edge of the crown 29 to the outer edge of brim 28. The underside of each guiding rib 35 includes a guide 37, such as a channel or conduit, positioned adjacent the lower peripheral edge of the crown 29 and two diverging eyes or conduits 41 positioned at the outer edge of the guiding rib 35. The drawstring 34 is guided through the guiding means 37 along the rib 35, wherein the drawstring 34 divides and a respective segment or strand passes through each eye 41 in opposing directions.

The respective strands of the drawstring 34 are directed fore and aft around the outer brim 28 via the eyes 41 of the locating ribs 36. Upon reaching the opposing guiding rib 35 the respective strands of the drawstring 34 each pass through the eyes 41 from their respective directions, join and are guided through the guiding means 37 to the lower peripheral edge of the crown 29. It is to be understood that the drawstring 34 may divide into two strands or may be two associated drawstrings 34.

The guiding ribs 35 are positioned substantially adjacent each ear of a wearer of the hat 26. The drawstring 34 extends from each guiding rib 35 at the lower peripheral edge of the crown 29 to form a chinstrap 38.

The skeleton 30 is preferably constructed from flexible, but substantially firm plastics material, such as PVC or other polymers, to give suitable support to the brim 12. The skeleton 30 is covered in a lightweight material or fabric to form the crown and brim. Suitably, the material is flexible, UV reflective and not adversely affected by immersion in fresh, chlorinated or salt water. The material may also be quick drying.

Figure 18:
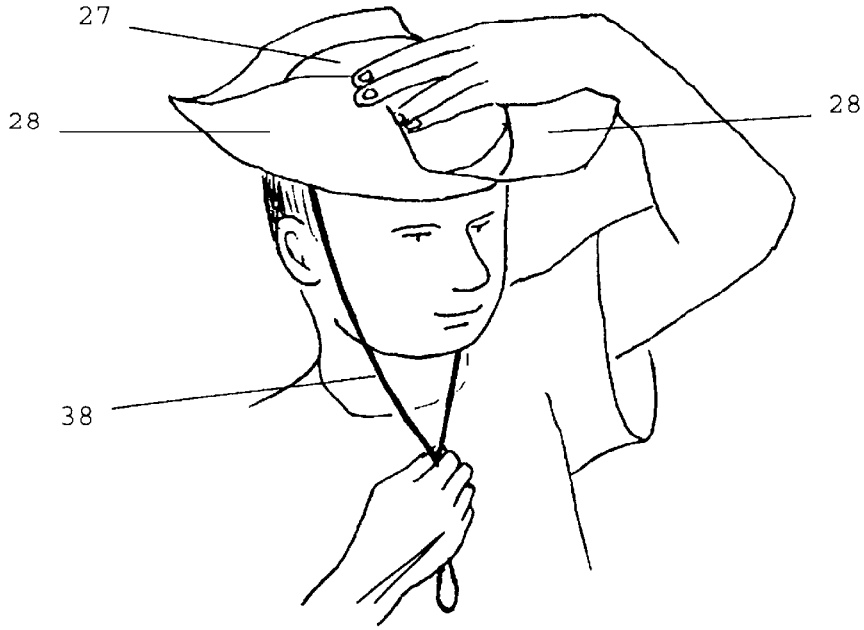
FIG. 18 illustrates a user converting the alternative form of the hat into a skull or swimming cap.
Figure 19:
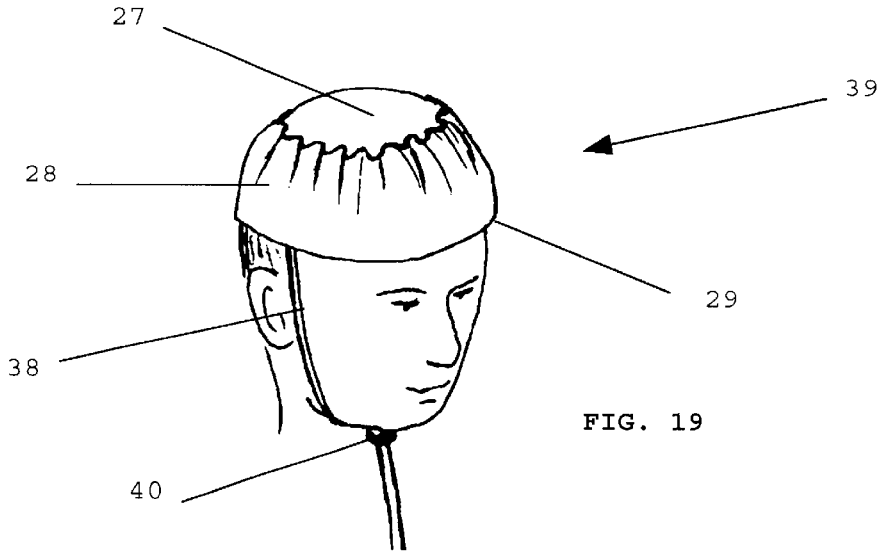
FIG. 19 illustrates a user wearing the alternative form of the hat as a skull or swimming cap.

Referring to FIGS. 18 and 19, the wearer pulls the chinstrap 38 shortening the length of drawstring 34 located around the outer edge of the brim 28. As the drawstring 34 shortens, the portion of the outer edge of the brim 12 between the ribs 32 gathers and/or folds causing the ribs to retract upward on the hinged connection 33 until the gathered brim 28 overlies the crown 29 forming a skullcap type configuration 39. The chinstrap 38 may include a toggle or other fastening means 40 to secure the hat 26 firmly on the user's head, whether the brim 28 is an operative or inoperative condition.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A convertible hat comprising:

a crown having a lower peripheral edge and an outer surface;

a soft brim having an outer peripheral edge, wherein the brim is hingedly connected to the lower peripheral edge of the crown and wherein the brim protrudes outwardly from the crown in an operative condition, and wherein the brim is retractable from the operative condition such that the brim substantially conforms to at least a portion of the outer surface of the crown; and at least one drawstring which is associated about the outer peripheral edge of the brim for gathering substantially the entire outer peripheral edge of the brim.

2. A convertible hat as defined in claim 1, wherein two drawstrings are associated with the outer peripheral edge of the brim.

3. A convertible hat as defined in claim 1, wherein the brim includes a plurality of spaced apart ribs for stiffening the brim and which permit a portion of the brim between the ribs to be gathered by the at least one drawstring, and wherein the hinged connection is between the lower peripheral edge of the crown and the ribs.

4. A convertible hat as defined in claim 3, wherein the hat is convertible to a skullcap type configuration by gathering the outer peripheral edge of the brim to a smaller dimension than the lower peripheral edge of the crown.

5. A convertible hat as defined in claim 4, wherein the outer edge of each rib includes a locator for locating the at least one drawstring around the outer peripheral edge of the brim.

6. A convertible hat as defined in claim 5, wherein the locator is a fork-like member having two opposing sides.

7. A convertible hat as defined in claim 5, wherein the locator is an eye through which the at least one drawstring is threaded.

8. A convertible hat as defined in claim 5, wherein the locator is a channel-like member having two opposing sides.

9. A convertible hat according to claim 5, wherein the locator is a conduit through which the at least one drawstring is threaded.

10. A convertible hat as defined in claim 3, wherein at least a portion of the outer peripheral edge of the brim is gathered when the at least one drawstring is pulled, and wherein the ribs retract on the hinged connection until the brim substantially conforms to at least a portion of the outer surface of the crown forming a skullcap type configuration.

11. A convertible hat as defined in claim 3, wherein the ribs and lower peripheral edge of the crown form a skeleton.

12. A convertible hat as defined in claim 11, wherein the skeleton is constructed from flexible, but substantially firm plastics material.

13. A convertible hat as defined in claim 11, wherein the skeleton is covered in a lightweight material or fabric forming the brim and crown.

14. A convertible hat as defined in claim 13, wherein the material or fabric is flexible, UV reflective and is not adversely affected by immersion in fresh, chlorinated, or salt water.

* * * * *